US006250125B1

(12) United States Patent
Ukai et al.

(10) Patent No.: US 6,250,125 B1
(45) Date of Patent: Jun. 26, 2001

(54) METHOD FOR PRODUCING IRON-BASE DISPERSION-STRENGTHENED ALLOY TUBE

(75) Inventors: Shigeharu Ukai; Shunji Mizuta; Tsunemitsu Yoshitake, all of Higashi Ibaraki-gun; Shigeki Hagi; Noriaki Hirohata, both of Amagasaki; Katsuhiro Abe; Takanari Okuda, both of Kobe, all of (JP)

(73) Assignee: Japan Nuclear Cycle Development Institute, Ibaraki-ken (JP)

( * ) Notice: Subject to any disclaimer, the term of this patent is extended or adjusted under 35 U.S.C. 154(b) by 0 days.

(21) Appl. No.: 09/526,480

(22) Filed: Mar. 15, 2000

(30) Foreign Application Priority Data

Mar. 19, 1999 (JP) ..... 11-076825

(51) Int. Cl.[7] ..... B21B 21/02
(52) U.S. Cl. ..... 72/214; 72/252.5

(58) Field of Search ..... 72/224, 225, 214, 72/209, 208, 250, 252.5

(56) References Cited

U.S. PATENT DOCUMENTS 4,713,955 * 12/1987 Peytavin ..... 72/214
5,533,370 * 7/1996 Kuroda et al. ..... 72/12.5

* cited by examiner

*Primary Examiner*—Lowell A. Larson
(74) *Attorney, Agent, or Firm*—Wenderoth, Lind & Ponack, L.L.P.

(57) ABSTRACT

A method of producing an iron-based dispersion-strengthened alloy tube (2-1) by utilizing a rolling machine having grooved rolls (5, 5-1) and a mandrel (9)for forming the tube (2-1) from a raw rolling tube (2). In the method, a length of contact between a rolling surface (6, 6-1) of a caliber formed by the grooved rolls and an outer circumference of the rolling tube is set to be 0.9 times or more of a circumferential length of the rolling tube over the entire area of the rolling region. It is preferred that the method be performed by a Pilger type rolling machine.

2 Claims, 5 Drawing Sheets

METHOD FOR PRODUCING IRON-BASE DISPERSION-STRENGTHENED ALLOY TUBE

BACKGROUND OF THE INVENTION

This invention relates to a method of producing an iron-base dispersion-strengthened alloy tube, with the use of a rolling machine having grooved rolls and a mandrel, by cold rolling or warm rolling.

An iron-base dispersion-strengthened alloy is known to have a structure in which inert particles such as oxides, nitrides, carbonides, intermetallic compounds, etc. are dispersed uniformly in an iron matrix. The materials are alloys which maintain a high strength to a temperature range near a melting point of iron, and have been extensively and favorably used for piping materials employed in high temperature and high pressure conditions such as boiler tubes, piping of internal combustion and fuel cladding tubes for fast breeder reactors in nuclear power generation.

The iron-base dispersion-strengthened alloy have been produced by a so-called powder metallurgy method in which inert particles as described above and powder of iron-base alloy are mixed by, for example, a ball mill, formed and sintered. There are cases that additional hot working is provided after sintering to form products having predetermined dimensions. However, since the alloy of this type has less deformability, there is a serious problem due to the difficulty of achieving a suitable warm or cold working as well as hot working.

A tube product such as a boiler tube and a fuel cladding tube needs cold working or warm working for at least a final working step, from a viewpoint of dimensional accuracy. However, the iron-base dispersion-strengthened alloy is of difficult workability and, therefore, cold working and warm working of tubes will cause cracking on the surfaces, resulting in difficulty in realization of production.

Japanese Patent 2,564,826 discloses a method for producing a tube from a dispersion-strengthened alloy. In the method, at least three double-enveloping or hourglass shaped rolls which are supported to a cam groove inclined to an axis of a rolling tube are simultaneously pressed against the same circumferential surface of a raw tube for a tube and the rolls are reciprocated in an axial direction of the raw tube for the tube, so that the raw tube is subjected to oscillation-rolling in a radial direction of the raw tube for reducing a diameter of the raw tube. According to the Japanese Patent described, the method disclosed therein allows favorable production having pipes of a small or reduced size in thickness and diameter. The rolling machine used therein is reported to be a HPTR-type rolling machine.

Here, FIGS. 1(*a*) and 1(*b*) show a principle of a rolling method conducted by the HPTR rolling machine of a three-roll type, wherein FIG. 1(*a*) is a partly section side view seen from a side of a rolling line and FIG. 1(*b*) is an enlarged view in transversal section as seen from a front side of the rolling line.

With reference to FIGS. 1(*a*) and 1(*b*), in the rolling method by the three-roll type HPTR rolling machine, a rolling tube (raw tube) 2 with a mandrel 1 inserted therethrough is treated with diameter-reduction working and thickness-reduction working by a reciprocal movement of rolls 3 in an axial direction of the rolling tube to obtain rolled tube material (finished tube) 2-1 having a small size in both diameter and thickness. The roll 3 is a rotary body having a double enveloping or hourglass shaped body in a transversal sectional view parallel to the axis of the roll as illustrated in FIG. 1(*b*) and, therefore, the shape of a rolling surface 3-1 is substantially the same as the shape of a caliber formed by the rolls which is used in steel bar rolling, etc. and thus, the entire circumference of the rolls is of the same curvature and same depth, and the curvature is equivalent to a curvature of outer diameter do of the rolled tube material (finished tube) after the rolling procedure. When the rolls 3 are advanced along with an inclined cam groove 4 from a starting position $R_1$ of rolling to a finishing position $R_2$ (shown by dotted lines) as indicated by an arrow "f" in FIG. 1(*a*), the rolls 3 are pressed downward by the cam groove 4 in a radial direction of the rolling tube 2 to proceed with the workings of diameter reduction and thickness reduction.

In case that an iron-base dispersion-strengthened alloy is subjected to rolling by HPTR rolling method, a rolling reduction achieved by a single working is 20 percent, at most, as disclosed in the Japanese Patent described above. Accordingly, it is almost impossible or at least difficult to increase a ratio of an outer diameter of the raw tube at the time of starting the rolling relative to an outer diameter of the finished tube after the rolling procedure and, therefore, in order to prepare a small diameter tube product from a raw tube having a large outer diameter, repetition of a number of working steps is required, which results in an extraordinary reduction in production efficiency.

Here, the term "rolling reduction" Rd recited above intends to mean a value which is obtained by the following equation (1).

$$Rd\,(\%) = \frac{\left\{\pi\left(\frac{Do}{2}\right)^2 - \pi\left(\frac{Di}{2}\right)^2\right\} - \left\{\pi\left(\frac{do}{2}\right)^2 - \pi\left(\frac{di}{2}\right)^2\right\}}{\left\{\pi\left(\frac{Do}{2}\right)^2 - \pi\left(\frac{Di}{2}\right)^2\right\}} \times 100 \quad (1)$$

In the equation (1), $D_o$ and $D_i$ are outer diameter and inner diameter, respectively, of the raw tube at the time of starting the working procedure, and $d_o$ and $d_i$ are outer diameter and inner diameter, respectively, of the finished tube immediately after completing the working process.

In the conventional HPTR rolling method, reasons for incapability of increasing the in rolling reduction by a single working procedure will be explained as set forth below.

FIGS. 2(*a*) and 2(*b*) show a contact condition or state between rolling tube and each of rolls at the time of tube production by the conventional three-roll type HPTR rolling machine, wherein FIG. 2(*a*) shows a state of contact at a start of the rolling procedure and FIG. 2(*b*) shows a state of contact at a finishing position of the rolling procedure.

At the start position of rolling ($R_1$ in FIG. 1) as shown in FIG. 2(*a*), only edge portions 3-2 of the roll 3 are contact with the rolling tube and other portions are not contact with the same. As draft is initiated by an advancing movement of the rolls 3, the edge portions 3-2 cut into a surface of the rolling tube 2 and this will cause cracks to be formed on the surface of the rolling tube.

As the working proceeds, the contact between the roll surface and the tube is increased. However, for a certain instance, there is a phenomenon that the rolling is proceeded with the contact being limited or small-scaled between the roll surface and the rolling tube until the contact region is extended so that a bottom of the rolling surface 3-1 is contact with the rolling tube. Particularly in one case of the iron-base dispersion-strengthened alloy tube, there is less elongation in a circumferential direction and difficulty in deforming the surface in line with the shape of the caliber of the rolls during the working procedure and, therefore, it is likely that a phenomenon as described above occurs. If it is tried to use a raw tube having an increased diameter to thereby proceed working with a large rolling reduction, a width of the roll which contacts the rolling tube is relatively reduced, so that a space between the rolls (that is, a non-arresting portion of the rolling tube) 3-3 is increased. On the non-arresting portion, a tensile stress is generated in a circumferential direction on the outer surface of the rolling tube and this results in the occurrence of cracks on the surface. These are the reasons why the rolling reduction cannot be increased.

SUMMARY OF THE INVENTION

It is, therefore, a general object of the present invention to provide a new method of producing an iron-base dispersion-strengthened alloy tube which permits high production efficiency in production of the tube.

Another object of the present invention is to provide a method of producing an iron-base dispersion-strengthened alloy tube, which permits efficient production of the tube of a small or reduced size in both diameter and thickness without the occurrence of surface discontinuities such as cracks, etc.

A further object of the present invention is to provide a new method of producing an iron-base dispersion-strengthened alloy tube of small diameter and thickness, which permits efficient production of the tube, with relatively large rolling reduction, the rolling reduction exceeding 20% in a single working procedure, without the occurrence of surface discontinuities such as cracks, etc.

To achieve the objects described above, the inventors performed various experiments to seek an iron-base dispersion-strengthened alloy tube, by using a Pilger rolling machine which has widely proved satisfactory results, particularly in the field of a fuel cladding tube (zirconium alloy) for a nuclear reactor, and which permits a large rolling reduction. As a result, in an entire area of a rolling region of each stroke of grooved rolls, provided that a contact length between a caliber formed by the grooved rolls and an outer circumference of the rolling tube (hereinafter, "roll contact length") is set to be 0.9 times or more of a circumferential length of the rolling tube, the inventors have recognized that surface defects such as cracks can be prevented even when the rolling is proceeded with a large rolling reduction. Besides, the inventors have recognized that similar results can be obtained by HPTR rolling machine and other types of rolling machines, provided that the conditions described above are maintained.

According to the present invention, as shown in FIG. 3, there is provided a method of producing an ion-base dispersion-strengthened alloy tube 2-1 by utilizing a rolling machine having grooved rolls 5, 5-1 and a mandrel 9 to form the tube 2-1 from a rolling tube (raw tube) 2, wherein a length of contact between a rolling surface 6, 6-1 of a caliber formed by the grooved rolls and an outer circumference of the rolling tube (that is, aforementioned roll contact length) is set to be 0.9 times or more of a circumferential length of the rolling tube in at least an entire area of a rolling region. Here, the term "rolling region" intends to mean a rolling region "R" shown in FIG. 4 which will be described later.

The method of the present invention described above can be applied in a cold rolling condition but, if desired, it can be carried out in a warm rolling condition at a temperature below re-crystallization temperature, for example, in a temperature range up to 700° C. with respect to an iron-base dispersion-strengthened alloy. Further, in the present invention, it will be preferred that Pilger rolling machine having grooved rolls is used. Other rolling machines such as the aforementioned HPTR rolling machine will be satisfactorily employed in one hand, Pilger rolling machine is more preferred so as to obtain an extremely large rolling reduction, by modifying in desired manners the shape of the caliber formed by the grooved rolls.

The iron-base dispersion-strengthened alloy referred herein intends to mean and cover alloys in which inert particles such as oxides, nitrides, carbonides, intermetallic compounds, etc. are dispersed uniformly, for strengthening purposes, in an iron matrix of the alloy. The alloys as described above are known per se and, therefore, desired alloy or alloys having required properties can be selected in view of the application of the alloys.

The term "raw tube" used herein intends to mean and cover a tube before the start of a working procedure. Thus, the raw tube used herein and applied in the present invention means and covers the tube produced from the iron-base dispersion-strengthened alloy(s) by, for example, a hot extrusion method, and thus the produced tube may further be treated by working such as cold working and treat, if required, by heat treatment. If working by the present invention is executed repeatedly, a tube which has been obtained by the previous rolling step is considered to be a "raw tube" for the following rolling step or steps.

DETAILED DESCRIPTION OF THE EMBODIMENTS

Figure 3A:
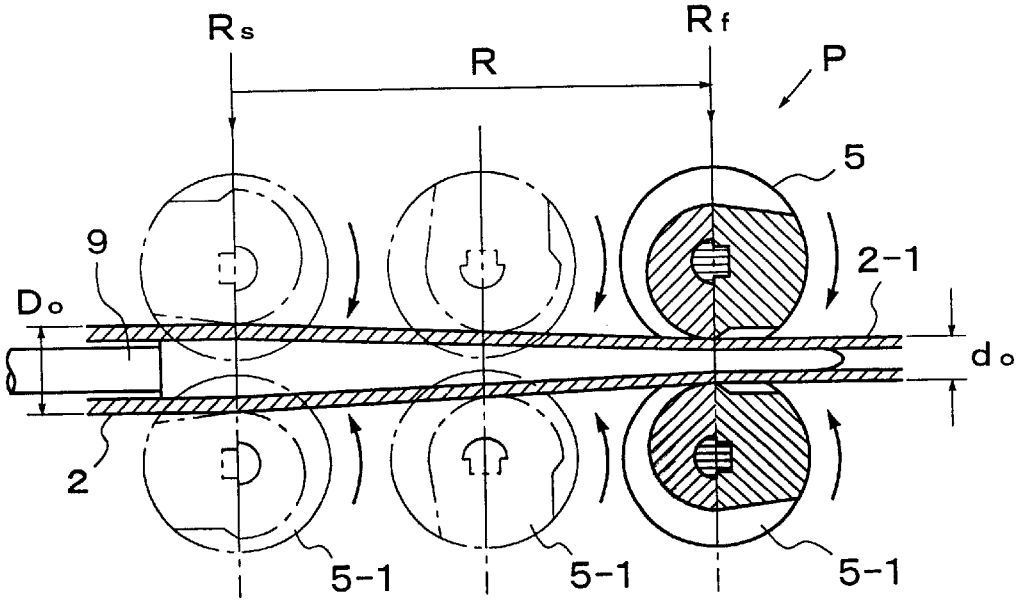
FIGS. 3(*a*), 3(*b*), 3(*c*) and 3(*d*) show a relation between grooved rolls of a Pilger rolling mill and a rolling tube, wherein FIG. 3(*a*) is a vertical sectional view seen from aside of the rolling line, and FIGS. 3(*b*), 3(*c*) and 3(*c*) are transversal sectional views seen from a front of the rolling line.
Figures 3B, 3C, 3D:
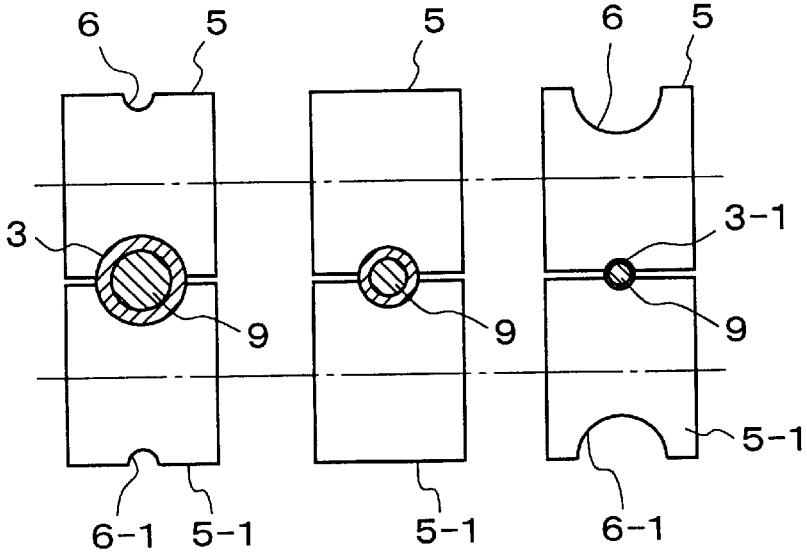

Referring first to FIGS. 3(*a*) to 3(*d*) showing diagrammatically an apparatus (Pilger rolling mill of 2-roll type) for achieving the method of the present invention, Pilger mill P serves to advance a pair of upper and lower grooved rolls 5, 5-1 while they are being rotated, so that diameter reduction working and thickness reduction working are applied to the rolling tube (raw tube) 2 into which a mandrel 9 is inserted. The grooved rollers 5, 5-1 are advanced from a starting position $R_s$ of the rolling to a finishing position $R_f$ of the rolling.

A caliber formed by grooves 6, 6-1 is formed smaller in a continuous manner from the starting position of rolling to a finishing position of rolling in a circumferential direction of the roll, as illustrated in FIGS. 3(*b*) to 3(*d*). Similarly, the mandrel 9 is formed so as to be tapered from the starting position of the rolling to the finishing position of the rolling.

Figure 4:
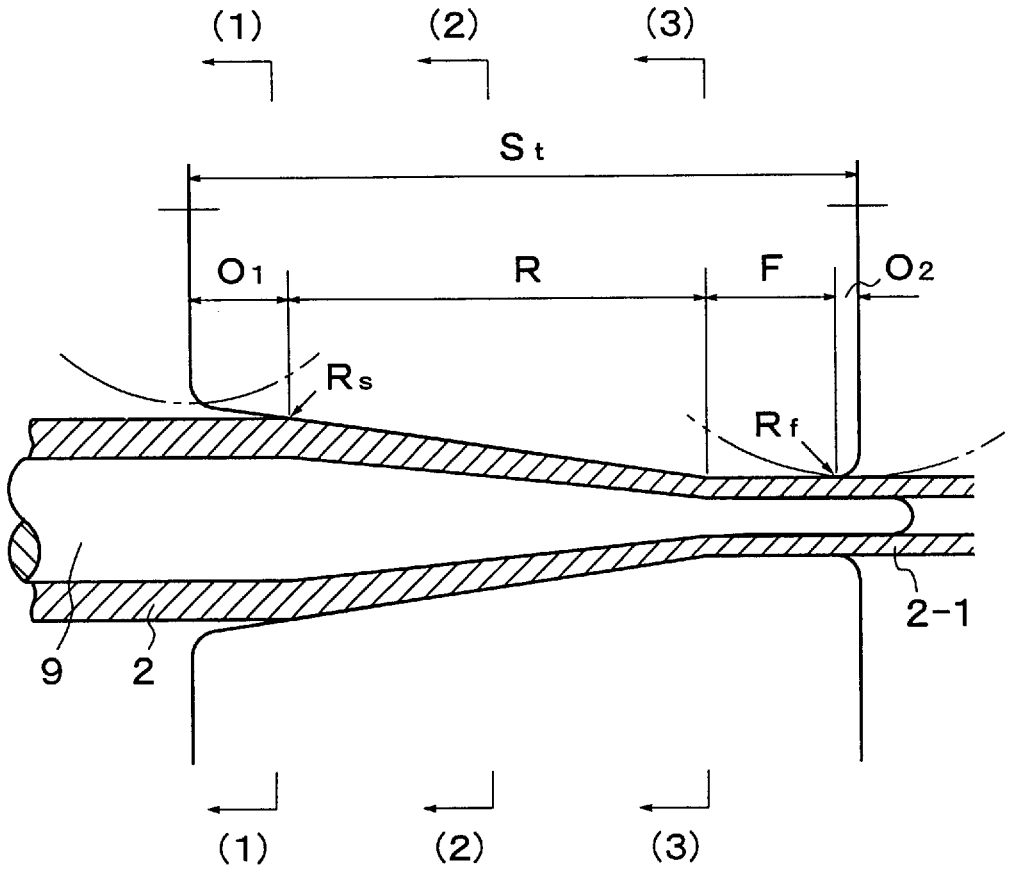
FIG. 4 is a diagram showing rolling states of a tube formed by the Pilger rolling mill.

With reference to FIG. 4, which shows a rolling state in one stroke of the roll of the Pilger rolling machine, a single stroke $S_t$ in Pilger rolling method is divided into four regions: a released region $O_1$ which is a pre-stage of the starting position $R_s$, a rolling region R following the released region $O_1$, a forming region F, and a released (second) region $O_2$ which is a post-stage of the forming region F.

In the rolling region R, an outer circumference of the rolling tube 2 is forcibly contacted with a rolling surface of the caliber, and an inner surface of the rolling tube is supported by the mandrel 9, a draft is added by rotation and advancing movement of the rolls, so that both diameter-reduction working and thickness-reduction working proceed to provide a stretched configuration of a predetermined dimension.

In the forming region F, working for controlling an outer diameter and a thickness of the rolling tube is hardly proceeded, but necessary dimensional adjustment is made to obtain the final dimensions. In the released region $O_2$, following the forming region F and the released region $O_1$ before the start position $R_s$, the caliber of the rolls is in a non-arrested condition in which the rolls are partly or entirely spaced from the rolling tube. In the released regions described, the rolling tube is rotated and moved slightly in an axial direction (approximately, 1–20 mm).

Figure 5A:
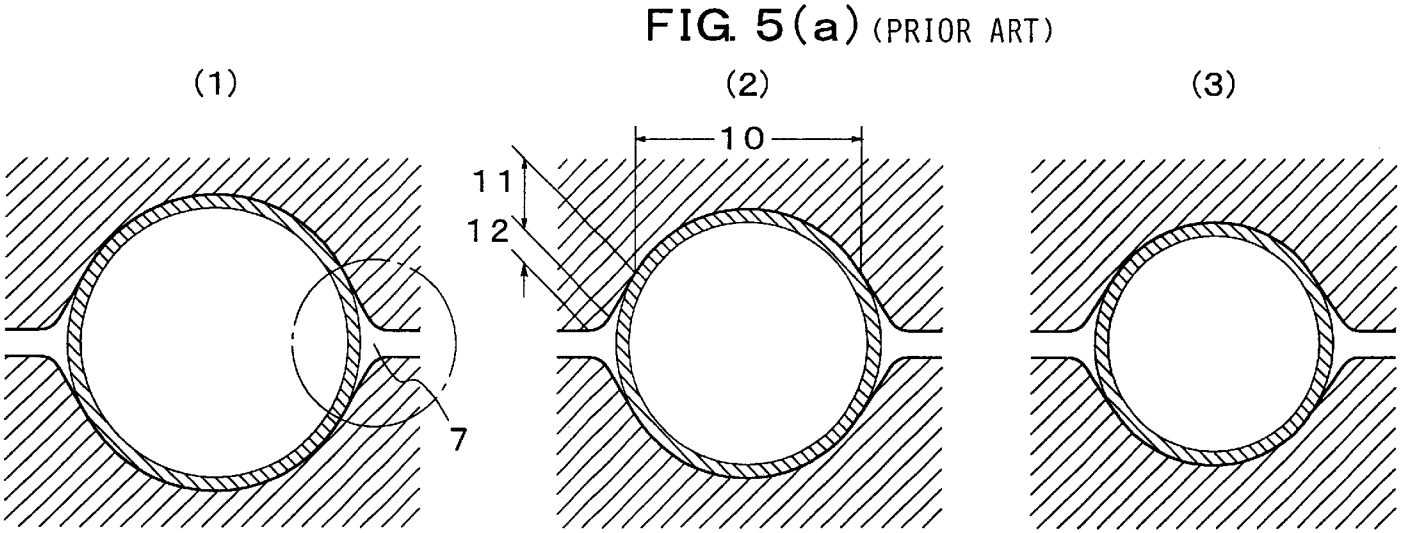
FIG. 5(a) (PRIOR ART)
FIGS. 5(*a*) and 5(*b*) show contact states between the caliber and the rolling tube from the start of rolling and the finish of the same by the Pilger rolling mill, wherein FIG. 5(*a*) shows a conventional method and FIG. 5(*b*) shows the method of the present invention.
Figure 5B:
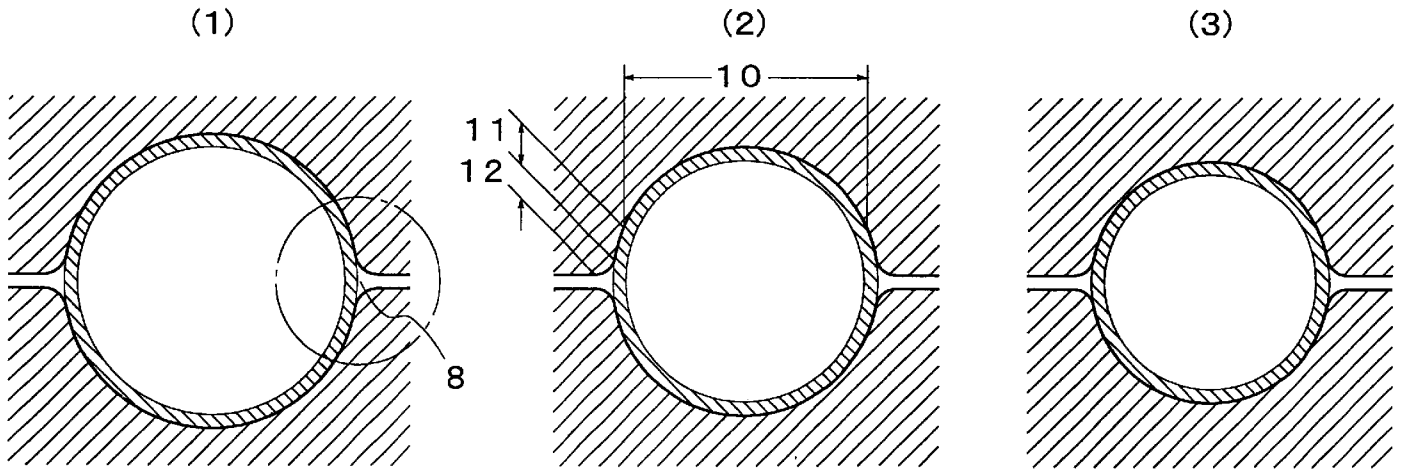

In FIG. 5(*a*), which shows a contact state between the caliber of the conventional Pilger roll mill and the rolling tube, (1) shows the state of the start of the rolling procedure, (3) the state of end of the same and (2) an shows intermediate state of the rolling procedure. These drawing figures correspond to sections of (1)-(1), (3)-(3) and (2)-(2), respectively, of FIG. 4. The shape of the groove in the circumferential direction of the grooved roll is formed with a complete round portion 10, a flange portion 11 having a larger radius of curvature than the complete round portion 10, and a comer portion 12. Thus, in a portion identified by reference numeral 7 of the state (1) of FIG. 5(*a*), no contact is made between the caliber formed by two grooves and the rolling tube and a ratio of the contact length relative to the outer circumference of the tube is generally limited to be less than 0.9. This value is smaller as it is near the initial stage of the working procedure. Therefore, if the conventional Pilger milling method is used to with a low elongation alloy tube such as the iron-base dispersion-strengthened alloy tube, it is likely that cracks which occur on the surface of the non-arrested portion of the rolling tube.

In FIG. 5(*b*), which shows a contact state between the caliber of the rolls and the rolling tube according to the present invention, (1) shows the state at the start of the rolling procedure, (3) shows the state of the end of the rolling procedure, and (2) shows an intermediate state. In the present invention, from the beginning of the rolling procedure to the finishing position of the rolling procedure, the caliber of the rolls is almost entirely contacting with the outer circumference of the rolling tube. In other words, the non-arrested portion 8 is apparently smaller than the portion 7 of the prior art state (1) of FIG. 5(*a*).

There would be some examples of methods for reducing the non-arrested portion as stated below:

(i) enlarging or increasing a range of the complete round portion 10 of the groove of the roll;

(ii) adjusting the radius of curvature of the flange portion 11 to be closer to that of the complete round portion 10; and (iii) rolling by minimizing a gap between upper and lower rolls.

By one of these methods or combination of any of these methods, a roll contact length relative to the outer circumference of the rolling tube can be made 0.9 times (that is, 90%) or more over the entire area of the rolling region.

As described above, if a roll contact length is 0.9 times or more of a circumferential length of the rolling tube over the entire area of the rolling region, a rolling reduction can be made as large as 65% by a single working procedure, as described in the embodiment of the invention which will be described below. Thus, the number of working steps, that is, the steps from the dimension of a stage of the raw tube to the dimension of a stage of a predetermined size of a final product, can be reduced to thereby establish improvement in production efficiency.

In the method of the present invention, any other kinds of roll-type rolling apparatuses or mills can be used rather than the Pilger type rolling mill as described above. For example, in case where the three-roll type HPTR rolling apparatus is used, the shape of the caliber of the rolls is determined in accordance with an outer diameter of the raw tube at the start of the working procedure, and a contact length between the rolling surface of the caliber and an outer circumferential surface of the rolling tube is maintained at 0.9 times or more, over an entire area of the rolling region, of an outer circumferential length of the rolling tube. This will make it possible to provide a desired rolling with 20% or more of a rolling reduction, by a single working procedure.

Examples of the present invention will now be described.

Example 1

Experiments were made by using two-roll Pilger rolling machine to produce thin-wall and small-diameter tubes under the conditions that various roll contact lengths are obtained as shown in Table 1. Alloys used therein were the two ones as set forth below.

Material A: 12% Cr—2% W—0.3% Ti—0.23% $Y_2O_3$

Material B: 9% Cr—2% W—0.2% Ti—0.35% $Y_2O_3$

Here, $Y_2O_3$ is an inert particle dispersed to an iron alloy matrix.

The sizes of the raw tubes produced by a hot extrusion method and the like from the alloys described above are shown in Table 1. The raw tubes were rolled under the conditions of rolling temperature, rolling reduction and a roll contact length as shown in Table 1. The sizes of the tubes after the single working procedure are shown in Table 1. The rolling reduction was obtained by the aforementioned equation (1). The thus obtained tube product was polished to an extent of 20 $\mu$m on the outer surface thereof and then subjected to a liquid penetrant inspection to examine any presence of cracks. The results are shown in Table 1.

TABLE 1

| Test Nr. | Materials | Rolling Temp. | Mat. Dimension (Outer Dia. × Wall Thickness: mm) Pre-Rolling | Post Rolling | Rolling Reduction (%) | Contact Length of Rolls / Circumferential Length of rolling tube Start of Rolling | End of Rolling | Number of Tested Tubes, N | Number of Tubes appearing cracks, n | Rate of Crack Occurrence = n × 100/N (%) |
|---|---|---|---|---|---|---|---|---|---|---|
| Examples of the invention | | | | | | | | | | |
| 1 | A | Cold Rolling (Room Temp.) | 8.9 × 0.82 | 7.1 × 0.535 | 47 | 0.90 | 0.90 | 10 | 0 | 0 |
| 2 | A | Cold Rolling (Room Temp.) | 8.9 × 0.82 | 7.1 × 0.535 | 47 | 0.93 | 0.93 | 10 | 0 | 0 |
| 3 | A | Cold Rolling (Room Temp.) | 12.3 × 1.38 | 9.3 × 0.60 | 65 | 0.90 | 0.90 | 5 | 0 | 0 |
| 4 | A | Warm Rolling (approx. 600° C. preheating) | 8.9 × 0.82 | 7.1 × 0.535 | 47 | 0.90 | 0.90 | 5 | 0 | 0 |
| 5 | B | Cold Rolling (Room Temp.) | 8.9 × 0.82 | 7.1 × 0.535 | 47 | 0.90 | 0.90 | 10 | 0 | 0 |
| Comparative Examples | | | | | | | | | | |
| 6 | A | Cold Rolling (Room Temp.) | 8.9 × 0.82 | 7.1 × 0.535 | 47 | 0.85 | 0.85 | 5 | 3 | 60 |
| 7 | A | Cold Rolling (Room Temp.) | 8.9 × 0.82 | 7.1 × 0.535 | 47 | 0.87 | 0.92 | 7 | 4 | 57 |
| 8 | A | Warm Rolling (approx. 600° C. preheating) | 8.9 × 0.82 | 7.1 × 0.535 | 47 | 0.87 | 0.92 | 5 | 2 | 40 |
| 9 | B | Cold Rolling (Room Temp.) | 8.9 × 0.82 | 7.1 × 0.535 | 47 | 0.87 | 0.92 | 7 | 3 | 43 |

Material A: 12%Cr-2%W-0.3%Ti-0.23%$Y_2O_3$
Material B: 9%Cr-2%W-0.2%Ti-0.35%$Y_2O_3$ As shown over Table 1, a roll contact length in an entire area of the rolling region was made 0.9 times or more of the circumferential length of the rolling tube in Examples of the present invention (Test Nos. 1 to 5) and, accordingly, tubes with no cracks could be obtained although the rolling reduction was in the range of 47–65%. This is considered to be based upon the fact that the non-arrested portion between the upper and lower rolls was limited to be minimum at the time of start of the rolling procedure and, therefore, a tensile stress in a circumferential direction of the non-arrested portion of the rolling tube is made smaller, with the favorable results that generation of cracks could be restricted.

By contrast, in the Comparative Examples (Test Nos. 6 to 9) in Table 1, in which a roll contact length at the start of the rolling procedure was less than 0.9 times of the circumferential length of the rolling tube, cracks were observed on the surface of the rolling tube. In the case of the Comparative Examples, since the non-arrested portions are large sized and, therefore, it is considered that a tensile stress in the circumferential direction on the surface of the rolling tube was increased to thereby result in generation of cracks.

Example 2

Figure 1A:
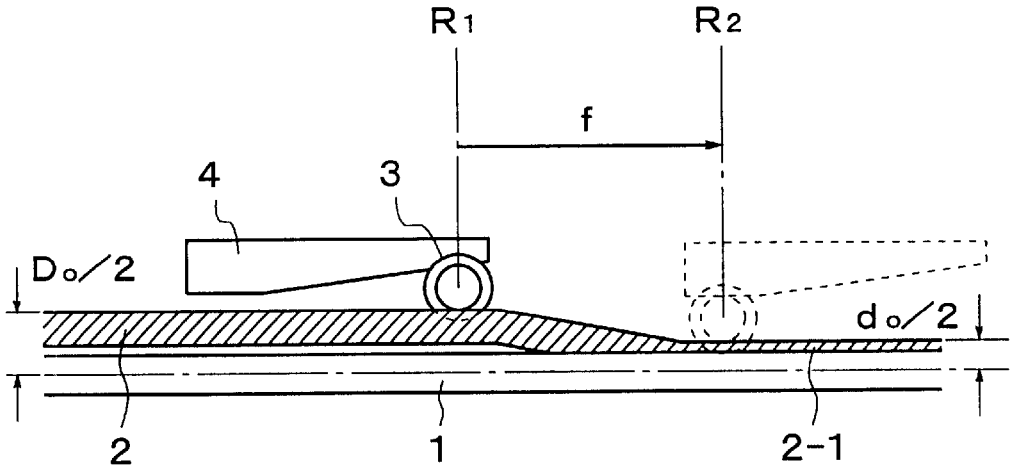
FIGS. 1(*a*) and 1(*b*) show a principle of a rolling method conducted by a three-roll type of HPTR rolling machine, wherein FIG. 1(*a*) is a partial section side view seen from a side of a rolling line and FIG. 1(*b*) is an enlarged transverse sectional view section seen from a front side of the rolling line.
Figure 1B:
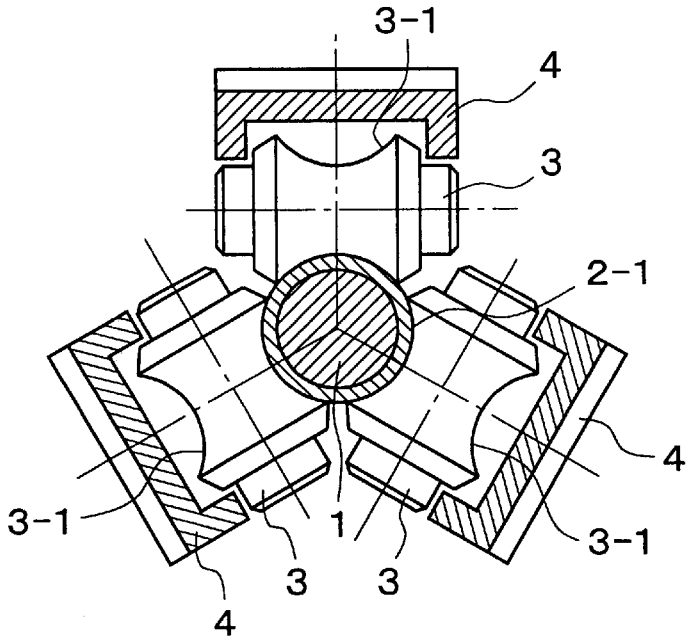
Figure 2A:
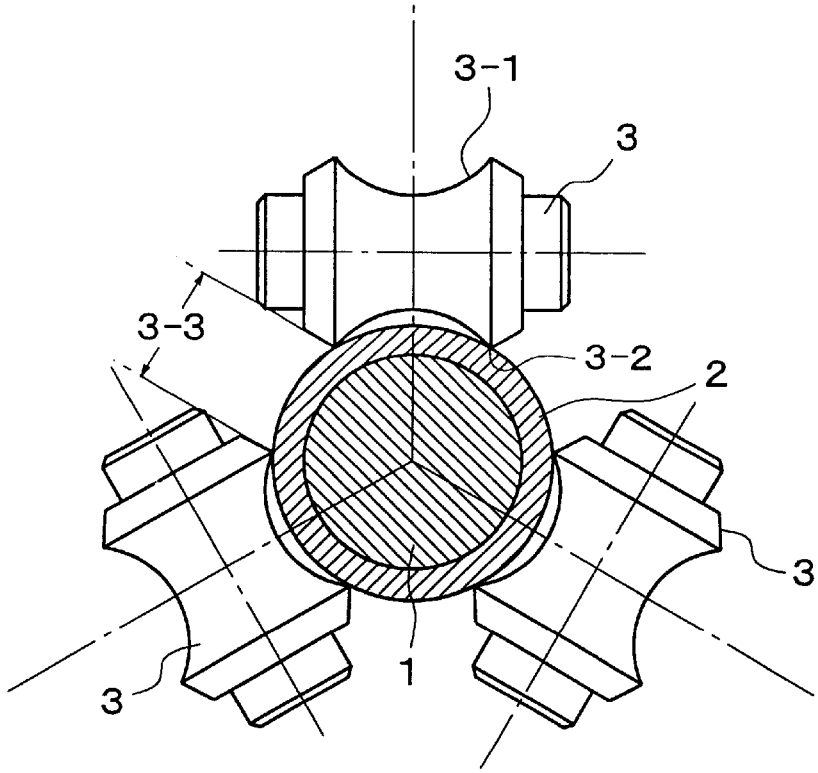
FIG. 2(a) (PRIOR ART)
FIGS. 2(*a*) and 2(*b*) show a contact condition or state between a rolling tube and each of the rolls at the time of tube production by the conventional three-roll type HPTR rolling machine, wherein FIG. 2(*a*) shows a state of contact at a start of the rolling procedure and FIG. 2(*b*) shows a state of contact at a finishing position of the rolling procedure.
Figure 2B:
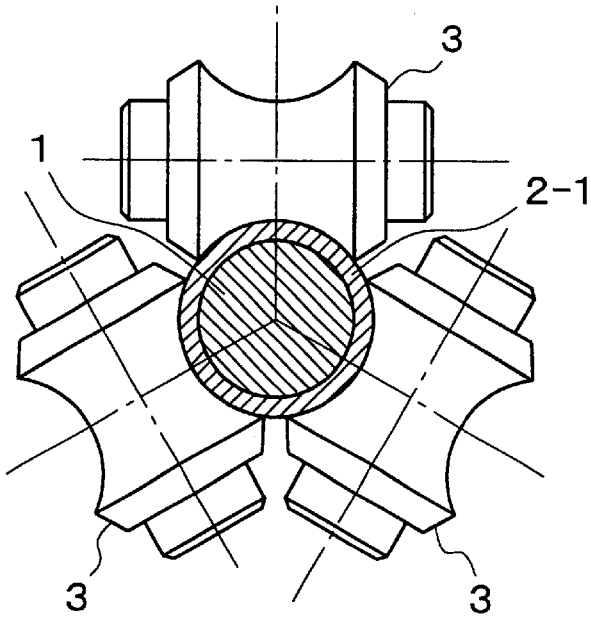
FIG. 2(b) (PRIOR ART)

The three-roll type HPTR rolling machine as shown in FIG. 1 was used to conduct experiments similar to those of Example 1. In Example 2, raw tubes having an outer diameter of 8.9 mm and a wall thickness of 0.82 mm were used to proceed a roll working to obtain tubes having an outer diameter of 8.0 mm and a wall thickness of 0.675 mm. In other words, the rolling reduction was constantly 25%. The experimental data are shown in Table 2.

As shown in Table 2, in Examples of the present invention (Test Nos. 10 to 12), a roll contact length from the start to the end of the rolling procedure was set to be 0.9 times or more of the circumferential length of the rolling tube and, therefore, an occurrence ratio of cracks was 0 (zero) although the rolling reduction was 25%.

By contrast, in the Comparative Examples (Test Nos. 13 to 16), a roll contact length, at the start of the rolling procedure, was less than 0.9 times of a circumferential length of the rolling tube and, therefore, the occurrence of cracks were observed on the surface of the rolling tube at rather high occurrence ratio.

As described above, it is successfully recognized that if a contact length of the caliber relative to the molding material is set to be 0.9 times or more, an application of the conventional three-roll type HPTR roll machine will permit a favorable production of tubes, without any occurrence of cracks, of reduced diameter and wall thickness, with a relatively large rolling reduction being as large as 25%.

TABLE 2

| Test Nr. | Materials | Rolling Temp. | Contact Length of Rolls / Circumferential Length of rolling tube: Start of Rolling | Contact Length of Rolls / Circumferential Length of rolling tube: End of Rolling | Number of Tested Tubes, N | Number of Tubes appearing cracks, n | Rate of Crack Occurrence = n × 100/N (%) |
|---|---|---|---|---|---|---|---|
| Examples of the Invention | | | | | | | |
| 10 | A | Cold Rolling (Room Temp.) | 0.90 | 0.92 | 7 | 0 | 0 |
| 11 | A | Warm Rolling (approx. 600° C. preheating) | 0.90 | 0.92 | 5 | 0 | 0 |
| 12 | B | Cold Rolling (Room Temp.) | 0.90 | 0.92 | 4 | 0 | 0 |
| Comparative Examples | | | | | | | |
| 13 | A | Cold Rolling (Room Temp.) | 0.85 | 0.95 | 4 | 2 | 50 |
| 14 | A | Cold Rolling (Room Temp.) | 0.81 | 0.91 | 5 | 4 | 80 |
| 15 | A | Warm Rolling (approx. 600° C. preheating) | 0.81 | 0.91 | 4 | 2 | 50 |
| 16 | B | Cold Rolling (Room Temp.) | 0.81 | 0.91 | 5 | 2 | 20 |

Material A: 12%Cr-2%W-0.3%Ti-0.23%$Y_2O_3$
Material B: 9%Cr-2%W-0.2%Ti-0.35%$Y_2O_3$ According to the present invention, a tube of a high dimensional accuracy can be obtained without the occurrence of surface defects such as cracks, by using a raw tube formed of an iron-base dispersion-strengthened alloy which is hard to work by cold rolling or warm rolling. Besides, the method of the present invention permits an increase in a rolling reduction in a single working process and, accordingly, the number of working steps is reduced, which results in the achievement of favorable production of tubes of a predetermined dimension or size. Further, the method of the present invention will contribute to extensive realization of tubes in various industrial fields such as boiler tubes, fuel cladding tubes for a nuclear power reactor, etc. by utilizing the iron-base dispersion-strengthened alloys which have excellent high temperature properties.

What is claimed is:

1. A method of producing an iron-based dispersion-strengthened alloy tube, the method comprising:

utilizing a rolling machine having grooved rolls and a mandrel for forming a tube by reciprocally moving the grooved rolls in an axial direction of the rolling tube so as to reduce a diameter and thickness of the rolling tube, wherein a stroke of the grooved rolls includes a rolling region, and the grooved rolls includes grooves defining a caliber; and contacting an outer circumference of the rolling tube with a rolling surface of the caliber over the rolling region such that a length of the contact between the caliber rolling surface and the outer circumference of the rolling tube is at least 0.9 times a circumferential length of the rolling tube over at least the entire area of the rolling region.

2. A method of producing an iron-based dispersion-strengthened alloy tube, the method comprising:

utilizing a Pilger type rolling machine having a pair of upper and lower grooved rolls and a mandrel for forming a tube by reciprocally moving the grooved rolls in an axial direction of the rolling tube in order to effect a reduction in the diameter of the rolling tube and a reduction in the wall thickness of the rolling tube, wherein a stroke of the grooved rolls includes a rolling region, and each of the grooved rolls include a groove surface, and the groove surfaces define a caliber; and contacting a rolling surface of the caliber with an outer circumference of the rolling tube such that a length of contact between the rolling surface of the caliber and the outer circumference of the rolling tube is at least 0.9 times a circumferential length of the rolling tube over at least the entire area of the rolling region.

* * * * *